US006295742B1

(12) United States Patent
Bathum

(10) Patent No.: US 6,295,742 B1
(45) Date of Patent: Oct. 2, 2001

(54) SANDAL WITH RESILIENT CLAW SHAPED CLEATS

(75) Inventor: Dale Bathum, Mercer Island, WA (US)

(73) Assignee: Bite, LLC, Preston, WA (US)

( * ) Notice: Subject to any disclaimer, the term of this patent is extended or adjusted under 35 U.S.C. 154(b) by 0 days.

(21) Appl. No.: 09/576,747

(22) Filed: May 23, 2000

(51) Int. Cl.[7] ..... A43B 23/28
(52) U.S. Cl. ..... 36/59 R; 36/59 C; D2/951
(58) Field of Search ..... 36/59 R, 59 C, 36/59 A; D2/951

(56) References Cited

U.S. PATENT DOCUMENTS

| | | | | |
|---|---|---|---|---|
| 1,070,951 | | 8/1913 | Elliott . | |
| 2,932,096 | | 4/1960 | Tavormina . | |
| 3,005,272 | * | 10/1961 | Shelare et al. | 36/59 C |
| 4,335,529 | | 6/1982 | Badalamenti | 36/59 |
| 4,404,759 | * | 9/1983 | Dassler | 36/59 C |
| 4,546,559 | | 10/1985 | Dassler | 36/129 |
| 4,550,510 | * | 11/1985 | Stubblefield | 36/59 C |
| 4,635,383 | | 1/1987 | Free | 36/7.6 |
| 4,641,438 | | 2/1987 | Laird et al. | 36/59 |
| 4,642,917 | | 2/1987 | Ungar | 36/59 |
| 4,741,114 | | 5/1988 | Stubblefield | 36/32 |
| 5,918,385 | | 7/1999 | Sessa | 36/59 |

* cited by examiner

*Primary Examiner*—M. D. Patterson
(74) *Attorney, Agent, or Firm*—Marvin E. Jacobs

(57) ABSTRACT

A sole contains a plurality of resilient claw-shaped lugs mounted on the side perimeter of the sole. The lugs face downwardly and curve inwardly to form an extension overhanging, the sole having an undercut of from 5–30 degrees forming pointed ends. As the sole is planted the pointed ends grip the surface. The resilient curved ends are compressed until they contact the sole. As the sole is raised the lugs raise toward their original position allowing rotation of the sole during a golf club swing.

8 Claims, 1 Drawing Sheet

SANDAL WITH RESILIENT CLAW SHAPED CLEATS

TECHNICAL FIELD

The invention relates generally to footwear and more specifically to the sole of a sandal containing resilient claw-shaped cleats.

BACKGROUND OF THE INVENTION

Sandals constitute one of the earliest footwear known to man. Typically, sandals incorporate either a leather or rubberized sole which can be attached to the human foot by straps extending across the Achilles heel, and toes of the user. Early sandals were designed for walking. Sandals however, have been recently developed for more demanding sports-related activities. More force and stress is applied to the sole, during the running, stopping and twisting moves during sports activities such as golf, hiking, climbing, etc.

In order to increase traction, manufacturers of sandals used in sports activities have added lugs, spikes and cleats of both hard materials such as metal and plastic and soft, resilient materials such elastomers. Hard spikes and cleats can be dangerous to the user or to other involved in the sports activity, especially rough, contact sports. Another problem with spikes is that individually they sharply penetrate the turf and can rotate. They cannot be used on hard surfaces such as wood, blacktop or concrete and provide no cushioning on any surface. Some hard cleats prevent rotation but can still have pointed protrusions that can be dangerous.

Softer spikes have recently been introduced that are less punishing to fairways, greens and hard indoor surfaces. However, these spikes do not adequately prevent rotation and allow the sole to slide.

Resilient lugs and cleats for sandals have been adapted from athletic shoes such as basketball and tennis shoes to be used with sandals. The lugs and cleats are primarily designed to grip smooth surfaces such as wood floors or tennis courts. The cleats and lugs are positioned within the perimeter of the sole and usually are aligned parallel to the longitudinal axis of the sole. Cleats that are positioned at the perimeter usually face downwardly or outwardly from the portion of the upper adjacent the sole.

List of Prior References

| U.S. Pat. No. | Patentee |
|---|---|
| 1,070,951 | Elliott |
| 2,932,096 | Tavormina |
| 4,335,529 | Badalamenti |
| 4,404,759 | Dassler |
| 4,546,559 | Dassler |
| 4,635,383 | Free |
| 4,641,438 | Laird, et al. |
| 4,642,917 | Ungar |
| 4,741,114 | Stubblefield |
| 5,918,385 | Sessa |

DISCUSSION OF PRIOR REFERENCES

Roof climbing overshoes with triangular spikes slanted outwardly along the periphery are disclosed by Elliot. Tavormina discloses serrated teeth on perimeter edge of the sole and heel portions of an anti-slip ice overshoe. Side mounted conical cleats for sportshoes are illustrated by Badalamenti. Elastic cleats at rim of a jogging shoe have pairs of blades—one pair oriented inwardly—one pair oriented outwardly past the rim are disclosed by Dassler ('759) in jogging shoe. Dassler's ('559) running shoe has an elastic sole with reinforcing ridges and profile projections. A roofing cleat with outwardly and downwardly projecting metal spikes is shown by Free. The running shoe disclosed by Laird et al has prism-shaped lugs on the bottom and sides of the sole. Ungar's athletic shoe has triangular cleats, some of which are disposed at the per-meter of the sole. A shoe having a concave middle sole and an outersole with tread members at and beyond periphery of sole is shown by Stubblefield. An outsole with rectangular inclined lugs arranged transverse to the longitudinal axis of the sole with an undercut permitting the lugs to collapse into the outsole is disclosed by Sessa. Ridges 36 and 52 are disposed at the side perimeter of the sole.

STATEMENT OF THE INVENTION

A sandal sole that provides comfort, resistance and stability is provided by this invention. The sole contains a plurality of claw-shaped lugs mounted on the perimeter of the sole formed of resilient material. The lugs have a downwardly facing base portion continuing to a curved, portion extending past and overhanging the base portion. The curved portion is undercut to form a pointed end. The lugs are mounted on the perimeter of the sole with all the curved portions facing inwardly. The lugs are preferably disposed with their base portions parallel to a tangent to the perimeter.

When the sole is placed on a surface, the pointed ends of the curved portions will first contact and grip the surface. As the lugs compress under the weight of the wearer of the sandal, the curved portions will depress into the open space in front of the base of the lug until the curved portions contact the sole. The compression of the curved portions provides a soft planting of the sole-reducing shock to the limbs and joints of the wearer. The lugs compress slowly providing a spring-like feel during running or walking. As the sole raised, the lugs slowly return to their original position. This allows rotation of the sole as a golfer progresses through his club swing and follow through.

The simultaneous contact of all or most of the claw-like lugs with the surface provides a stable planting which prevents sliding or twisting of the sole. Lugs that face the same direction and/or are not mounted at the perimeter facing a greater degree of sliding and twisting of a sole planted on the surface.

These and other features and attendant advantages of the invention will become better understood by reference to the following detailed description when considered in conjunction with the accompanying drawings.

DETAILED DESCRIPTION OF THE INVENTION

Figure 1:
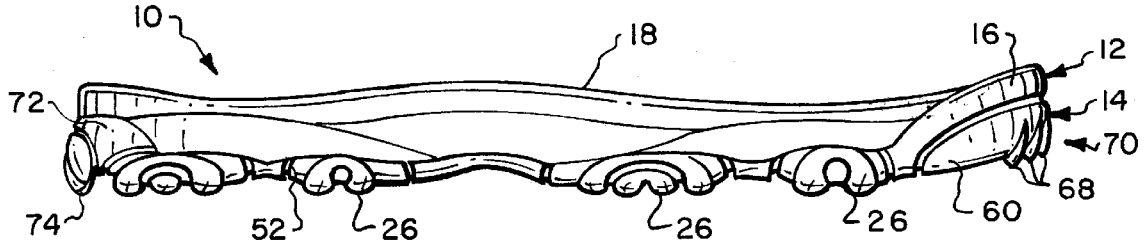
FIG. 1 is a side view in elevation of a sole containing the claw-shaped lugs according to the invention.
Figure 2:
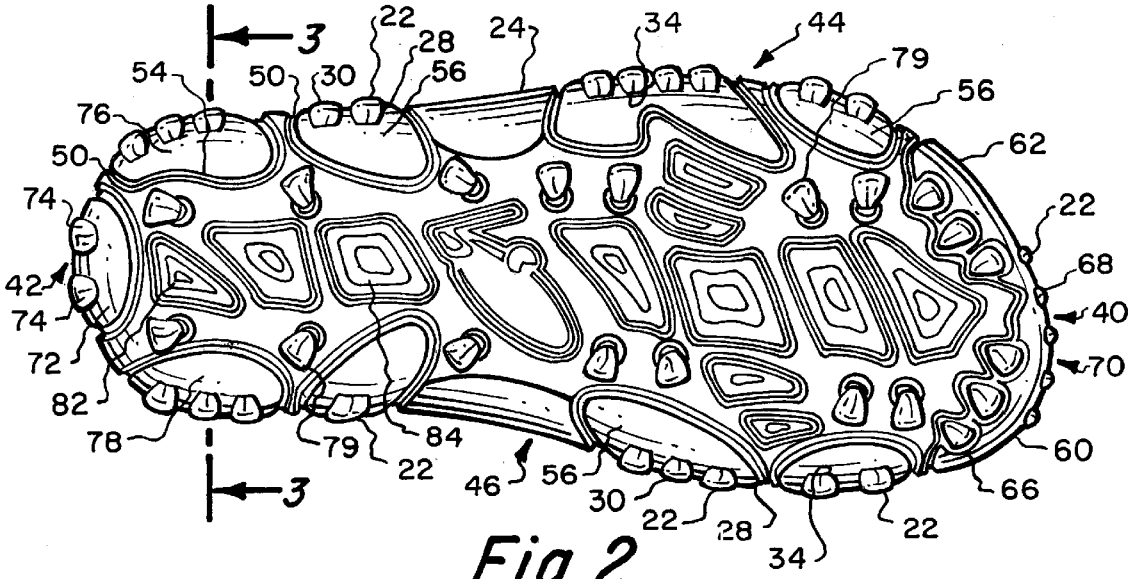
FIG. 2 is a bottom view in elevation of the sole shown in FIG. 1.
Figure 3:
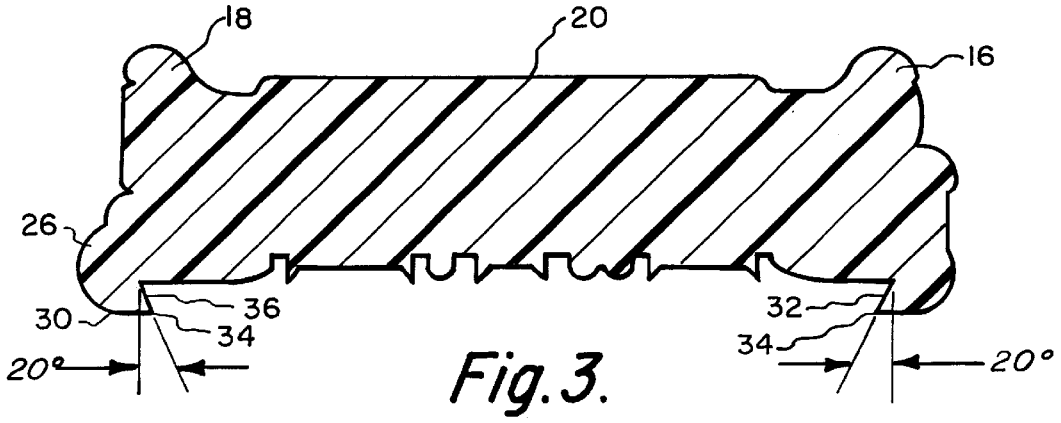
FIG. 3 is a view in section later along line 3—3 of FIG. 2.

Referring now to FIGS. 1–3 a sole 10 according to the invention comprises an upper foot receiving member 12 and a lower member 14 for contacting the ground surface. When the sole 10 is used for a sandal, the outer perimeter can contain a lip 16 for restraining the foot of a user within the sandal The foot receiving surface 18 can contain a raised heel pad 20 and have other contoured features such as a raised arch support, not shown. The sole could be a unitary molded structure. It is usual to form the top and lower members separately and adhere them together with adhesive. The lower ends of the sandals straps can be fed though slots in the upper member and disposed between the upper and lower members before adhesive is applied. Preferably, both the upper and lower members are formed of resilient, elastomeric materials.

The lower member 14 contains a plurality of claw-shaped lugs 22 which are mounted on the perimeter 24 of the lower member 14. The lugs 22 are formed of a tough, resilient elastomer. The lugs 22 have a base portion 26 attached to the side edge 28 of the lower member. A curved portion 30 is connected to the base portion 26. The curved portion terminates in an edge 34. The inner vertical wall 36 of the lug 22 slants from the edge 34 toward the perimeter 24 of the lower member by at least 5° to about 35° preferably about 20° forming a pointed overhang 32. All of the edges 34 face inwardly. The lugs can be placed all around the perimeter such as the toe end 40, heel end 42, outer side edge 44 and inner side edge 46. This provides excellent grip support and stability to plant the sole on soft terrain such as grass while preventing unwanted rotation of the sole. The curved portion 30 can converge to a point but preferably has a width similar to the side or base portion. The broad, curved sections provides good support and shock absorption as the curved sections bend and compress toward the center of the sole.

The lugs 22 can be directly mounted to the lower member by being integrally molded with the member or adhesively secured to the sole. In a preferred embodiment of the invention, a plurality of cavities 50 having a side relief 52 joined to a bottom relief 54 are formed in the bottom sole member 14. The lugs 22 can be integrally formed on an support 56 which can be adhesively secured in the cavities 50. The supports 56 need not have the same size or contain the same numbers of lugs. Nor need the lugs be the same size.

For example a front support 60 can extend from the outside edge 62, across the front 40 and around the inside edge 66 of the sole. The front support can contain 5 small lugs 68 disposed across the front 70 of the support 60.

A rear support 72 can contain 2 lugs 74. Side supports 76, 78 can contain 2 lugs and/or 3 lugs.

The bottom face of the sole can contain other support, cushioning gripping numbers, such as triangular spikes 79 which can also face inwardly and raised, 3 sided and 4 sided features 82, 84, respectively having varied shapes.

The sole of the invention has particular advantages for use as on a sandal to be worn when playing golf. The inwardly facing claw-shaped lugs along the perimeter engage the grass on the fairway or green and clamp the grass inwardly as the weight of the golfer bears on the lugs and bends the horizontal sections to advance the pointed edges downwardly and inwardly.

The soft elastomeric lug projections on the perimeter of the sole will not damage the green on fairways or the floor surfaces within a restaurant or golf club. The sandals can be worn and used at anytime, simplifying the equipment the golfer needs to carry.

It is to be realized that only described, and that embodiments of this invention have been described, and that numerous substitutions, modifications, alterations, and applications are permissible without departing from the spirit and scope of the invention as defined in the following claims.

What is claimed is:

1. A sole for shoes comprising;

a resilient upper member having a top surface including an outwardly facing cavity for receiving a foot and having a bottom surface;

a resilient lower member having an outwardly facing bottom surface for engaging the ground and having a top surface;

means joining opposed, inner facing top and bottom surfaces of the upper and lower members to form a sole having an outer perimeter with a vertical side wall; and a plurality of resilient lugs having a, base portion attached to said side wall at the perimeter and having a curved portion having one end connected to the base portion and a curved extension overhanging and spaced from the bottom surface of the lower member.

2. A sole according to claim 1 in which the lugs are disposed around said perimeter wall.

3. A sole according to claim 2 in which the sole has a toe portion, heel portion and side portions and the lugs are disposed at said portions of the sole.

4. A sole according to claim 1 in which the curved extension has a bottom wall facing downwardly and a slanted inner wall facing said bottom surface.

5. A sole according to claim 4 in which the inner wall of the extension slants at an angle from about 5° to about 35°.

6. A sole according to claim 5 in which the angle is about 20°.

7. A sole according to claim 1 in which the lugs are formed on supports and further including cavities formed in the side perimeter wall and in the bottom surface of the resilient lower member of the sole for receiving said supports.

8. A sole according to claim 7 in which each support contains from 2–8 lugs.

* * * * *